US007567770B2

(12) United States Patent
Ahl et al.

(10) Patent No.: US 7,567,770 B2
(45) Date of Patent: Jul. 28, 2009

(54) TRANSFER ASSEMBLY AND A METHOD FOR MOUNTING

(75) Inventors: David K. Ahl, Rochester, NY (US); Douglas A. McKeown, Geneseo, NY (US); Robert A. Gross, Penfield, NY (US); Michael G. Petranto, Webster, NY (US); Youti Kuo, Penfield, NY (US); Mark Stevens, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/510,047

(22) Filed: Aug. 25, 2006

(65) Prior Publication Data

US 2006/0285881 A1 Dec. 21, 2006

Related U.S. Application Data

(62) Division of application No. 10/900,644, filed on Jul. 28, 2004, now Pat. No. 7,418,222.

(51) Int. Cl.
*G03G 15/08* (2006.01)

(52) U.S. Cl. ..... 399/121; 399/124; 399/400

(58) Field of Classification Search ..... 399/107, 399/110, 121, 124, 400
See application file for complete search history.

(56) References Cited

U.S. PATENT DOCUMENTS

| | | | | |
|---|---|---|---|---|
| 4,116,556 | A | 9/1978 | Tanaka et al. | |
| 4,806,967 | A * | 2/1989 | Newbury | |
| 4,992,835 | A | 2/1991 | Matsuzaka | |
| 5,095,334 | A | 3/1992 | Nukaya | |
| 5,124,759 | A | 6/1992 | Fukuchi et al. | |
| 5,160,963 | A | 11/1992 | Haneda et al. | |
| 5,191,383 | A * | 3/1993 | Watanabe | 399/124 |
| 5,255,061 | A | 10/1993 | Matsuura et al. | |
| 5,371,575 | A | 12/1994 | Sekino et al. | |
| 5,761,596 | A * | 6/1998 | Osbourne et al. | 399/124 |
| 5,771,428 | A | 6/1998 | Marumoto et al. | |
| 5,819,139 | A * | 10/1998 | Harlan et al. | 399/110 |
| 5,923,935 | A | 7/1999 | Yamaguchi | |
| 6,016,409 | A * | 1/2000 | Beard et al. | 399/110 |
| 6,157,797 | A | 12/2000 | Saito et al. | |
| 6,650,866 | B1 | 11/2003 | Ahl et al. | |
| 2002/0051653 | A1 | 5/2002 | Toba et al. | |
| 2003/0072596 | A1 | 4/2003 | Kamano et al. | |
| 2003/0147668 | A1 | 8/2003 | Konno | |

FOREIGN PATENT DOCUMENTS

EP 0 562 648 A2 * 9/1993

* cited by examiner

*Primary Examiner*—David M Gray
*Assistant Examiner*—Laura K Roth
(74) *Attorney, Agent, or Firm*—Oliff & Berridge, PLLC

(57) ABSTRACT

An electrophotographic printing apparatus includes a housing, a photoreceptor module located inside the housing that includes a photoreceptor, a raster output system located inside the housing for projecting an electrostatic image onto the photoreceptor, a charging station, a developer station, a transfer station, a pre-fuser transport, and a fusing station. The module may be removed from an operating position inside the housing. The transfer station is connected to the pre-fuser transport so that they are constrained to move as one unit when the photoreceptor module is in its operating position inside the housing but are disconnected when the photoreceptor module is removed from its operating position inside the housing. The transfer module may be mounted so as to be constrained by a pre-fuser transport.

4 Claims, 5 Drawing Sheets

TRANSFER ASSEMBLY AND A METHOD FOR MOUNTING

This is a divisional of U.S. application Ser. No. 10/900,644 filed Jul. 28, 2004 now U.S. Pat. No. 7,418,222, by the same inventors, and claims priority therefrom. This divisional application is being filed in response to a restriction requirement in that prior application and contains re-written and/or additional claims to the restricted subject matter.

The embodiments disclosed herein are directed to jam clearance and more specifically to a method and apparatus for easing the removal of toner receivers when a print engine jams.

A typical electrophotographic printing machine employs a photoconductive member that is charged to a substantially uniform potential to sensitize the surface thereof. The charged portion of the photoconductive surface is exposed to a light image. Exposure of the charged photoconductive surface selectively dissipates the charge thereon in the irradiated areas to record an electrostatic latent image on the photoconductive surface corresponding to the informational areas being reproduced by the printing machine. After the electrostatic latent image is recorded on the photoconductive surface, the latent image is developed by bringing a developer material into contact therewith. Generally, the electrostatic latent image is developed with dry developer material having carrier granules with toner particles adhering thereto. However, a liquid developer material may be used as well. The toner particles are attracted to the latent image forming a visible image on the photoconductive surface. After the electrostatic latent image is developed with the toner, the toner image is transferred to a sheet. The toner image is then heated to permanently fuse it to the sheet.

The transfer and/or pretransfer assemblies of some printing devices include guide baffles to flatten sheets to which images are to be transferred. Often the outboard ends of these baffles are mounted together at the outboard end. This prevents jammed sheets in this area from being pulled directly out from between them. They must be either advanced through or pulled backward out of the transfer module. In other print engines, the outboard end of the transfer assembly is mounted directly to the photoreceptor module, creating the same effect.

This can lead to a problem when particular toner receiving substrates are used. Some printers print to shorter paper such as A5 paper (5.5"×8.5"), which is so short that it could conceivably become jammed in the transfer area with neither end accessible. Also, large format and heavy paper can be difficult to remove as well. For example, some printers print to paper that is over 18" long or that weighs 280 g/m$^2$, which is so stiff that it cannot be pulled out around any obstructions. Large and heavy sheets are difficult to pull forward or backward through the transfer module, and therefore, it is often necessary to pull such sheets straight out of the transfer area.

To help clear jams involving sheets such as A5 paper and large format or long heavyweight paper, in embodiments, a transfer assembly can be mounted on a pivot in the rear, allowing it to be lifted off of the photoreceptor module to clear jams. In embodiments, the assembly includes first and second baffles mounted separately. In embodiments, one would be attached to the transfer module and the other would be mounted separately; for example, the other may be attached to the photoreceptor module. The two are not connected at the outboard side. A "prop rod" mechanism could be used to hold the assembly open for removal and/or replacement of the photoreceptor belt.

Embodiments include a photoreceptor module located within a housing. The photoreceptor module includes a photoreceptor belt, a belt support to maintain the belt in a desired configuration, and a transfer assembly. The transfer assembly is operably positioned in close proximity to the belt, and may be moved away from the belt while both are within the housing to ease clearance of paper jams. In embodiments, moving the assembly away from the photoreceptor module includes pivoting the assembly away from the module.

Embodiments also include an electrophotographic printing apparatus, including a housing, a photoreceptor module located inside the housing that includes a photoreceptor, a raster output system located inside the housing for projecting an electrostatic image onto the photoreceptor, a charging station, a developer station, a transfer station, a pre-fuser transport, and a fusing station. The module may be removed from an operating position inside the housing. The transfer station is connected to the pre-fuser transport so that they are constrained to move as one unit when the photoreceptor module is in its operating position inside the housing.

Various exemplary embodiments will be described in detail, with reference to the following figures, wherein.

The terms "imaging device," "printer," and "printing device," as alternatively used herein broadly encompass various printers, copiers or multifunction machines or systems, xerographic or otherwise, unless otherwise indicated or defined in a claim. The terms "sheet" and "paper" are used generically herein to refer to a sheet of paper, plastic, or other suitable substrate for images.

Figure 5:
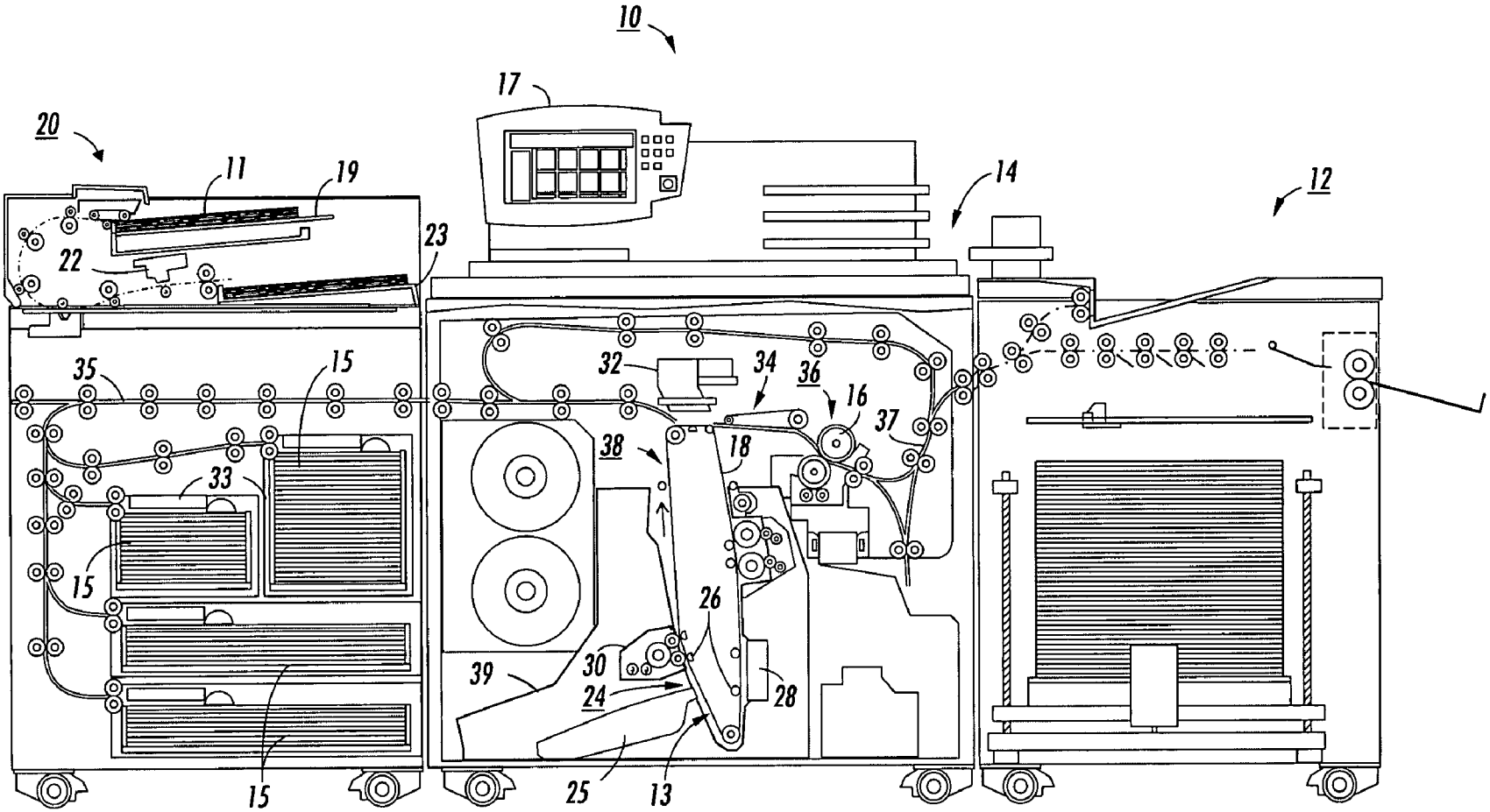
FIG. 5 is a schematic elevational view depicting an illustrative electrophotographic printing machine incorporating the apparatus of the present invention therein.

In electrophotographic machines, such as, for example, the device 10 illustrated in FIG. 5, a set of original documents 11 to be copied is placed on tray 19 of an automatic document handler 20. The machine operator enters the desired copying instructions, such as, for example, number of copies or sets of copies, through the control panel 17. The automatic document handler transports the documents 11 serially from the tray and past a scanning station 22 which scans each document, thereby producing digital image signals corresponding to the informational areas on the original document. Once scanned, the documents are deposited in an output tray 23. Additionally, information and instructions could come from a data storage medium or, if the device is connected to a network, they could come from a remote location such as a desktop computer.

The image signals are projected upon the uniformly charged surface of the photoreceptor at an imaging station 24 by a raster output system 25 to form a latent electrostatic image of the scanned informational areas of the original document thereon as the photoreceptor is moved passed the imaging station. In embodiments, the photoreceptor 18 is in the form of a flexible, endless belt 18 having a photoconductive outer surface 13. The photoreceptor may also be in other forms, such as, for example, a drum.

In embodiments, the photoreceptor 18 is mounted on a photoreceptor module 38. A set of rollers and backing members 26 are located opposite various stations support the belt 18. Other photoreceptor belt configurations are also possible. Before entering the imaging station 24, a charging station 28 uniformly charges the photoreceptor surface 13. The exposure of the charged surface of the photoreceptor to the digital signals at the imaging station discharges the photoreceptor surface in the areas struck by the digital image signals. Thus, there remains on the photoreceptor surface a latent electrostatic image in image configuration corresponding to the informational areas on the original. As the photoreceptor continues its movement, the latent electrostatic image thereon passes through developing station 30 where oppositely charged toner is deposited on the latent electrostatic image to form a toner image.

The photoreceptor movement continues transporting the toner image from the developer station to a transfer station 32. A paper supply 33 feeds a sheet 15 to a sheet transport 35 for travel to the transfer station. The sheet moves into aligned and registered contact with the toner image at a speed synchronistic with the moving photoreceptor. Transfer of the toner image to the sheet is effected and the sheet with the toner image is stripped from the photoreceptor and conveyed to a fusing station 36 having fuser device 16 where the toner image is fused to permanently fix the toner image to the sheet. After the toner image is fixed to the sheet, the sheet is transported by sheet transporting mechanism 37 to a finishing station 12 where the sheets with the permanent images thereon may be compiled into sets of sheets and finished by being stapled, bound, or the like.

Reference is now made to FIGS. 1-4, which show schematic views of the transfer module 32 and its position relative to the photoreceptor 18 in more detail. The transfer assembly 32 is described in detail in U.S. Pat. No. 6,650,866, hereby incorporated by reference.

In embodiments, the transfer assembly 32 includes an upper transfer baffle 40 and a lower transfer baffle 42, which help guide the sheet to be printed on so that it stays flat against the belt 18 during transfer. The baffles, 40, 42 are seen most clearly in the embodiment shown in FIG. 3. A sheet, in contact with the toner powder image on belt 18, is advanced with belt 18 to a first corona generator 44. See FIG. 3. Corona generator 44 sprays ions onto the backside of the sheet to effect the transfer of the toner powder image from belt 18 to the sheet. The sheet is maintained against belt 18 during the transfer process and eventually the lead edge of the sheet reaches, or is advanced beneath a second corona generator 46. The sheet, now having the toner powder image deposited thereon, is conveyed to the fusing module via vacuum transport 34 (shown in FIGS. 3 and 4), which will also be referred to as the pre-fuser transport 34. Vacuum transport 34 moves the sheet in the direction of arrow 41 to fusing station 36.

While baffles 40 and 42 are described in terms of upper and lower baffles, this need not be the case. A set of first and second baffles may be arranged in upper and lower positions, side-by-side positions, or other positions in between. Their arrangement relative to each other is more significant than their specific orientation relative to the ground.

In embodiments, the upper baffle 40 and the lower baffle 42 are mounted to the photoreceptor module 38 at their inboard ends, but not at their outboard ends. The transfer assembly 32 may be mounted on a pivot pin 48 in a bracket 49 at the inboard side of the photoreceptor module 38. This feature can be seen more clearly in FIG. 2. The outboard ends of the baffles 40, 42 can be latched together. When the customer needs to clear a jam, the customer may unlatch the outboard end of the transfer module, thereby allowing the upper baffle to pivot away from the outboard end of the lower baffle. Tolerance control for the spacing of the corotrons 44, 46 is provided by fixed staging points on the transfer module frame that rest on the photoreceptor frame in the closed position.

In other embodiments, the entire transfer module may pivot away from the photoreceptor belt. The module itself may be latched to the photoreceptor assembly or its support structure.

A latch handle 50 can be used to hold the outboard end of the upper baffle 40 to the outboard end of the lower baffle 42 (or alternatively, to hold the transfer module 32 to the outboard frame of the photoreceptor module 38.) In embodiments, the latch handle 50 can contain a spring element allowing the transfer assembly to be pulled close with a desired amount of force. Alternatively, the spring element may be mounted directly to the photoreceptor module itself. Also, in embodiments, such as that shown in FIG. 1, the latch handle 50 is connected to the upper baffle 40.

Figure 1:
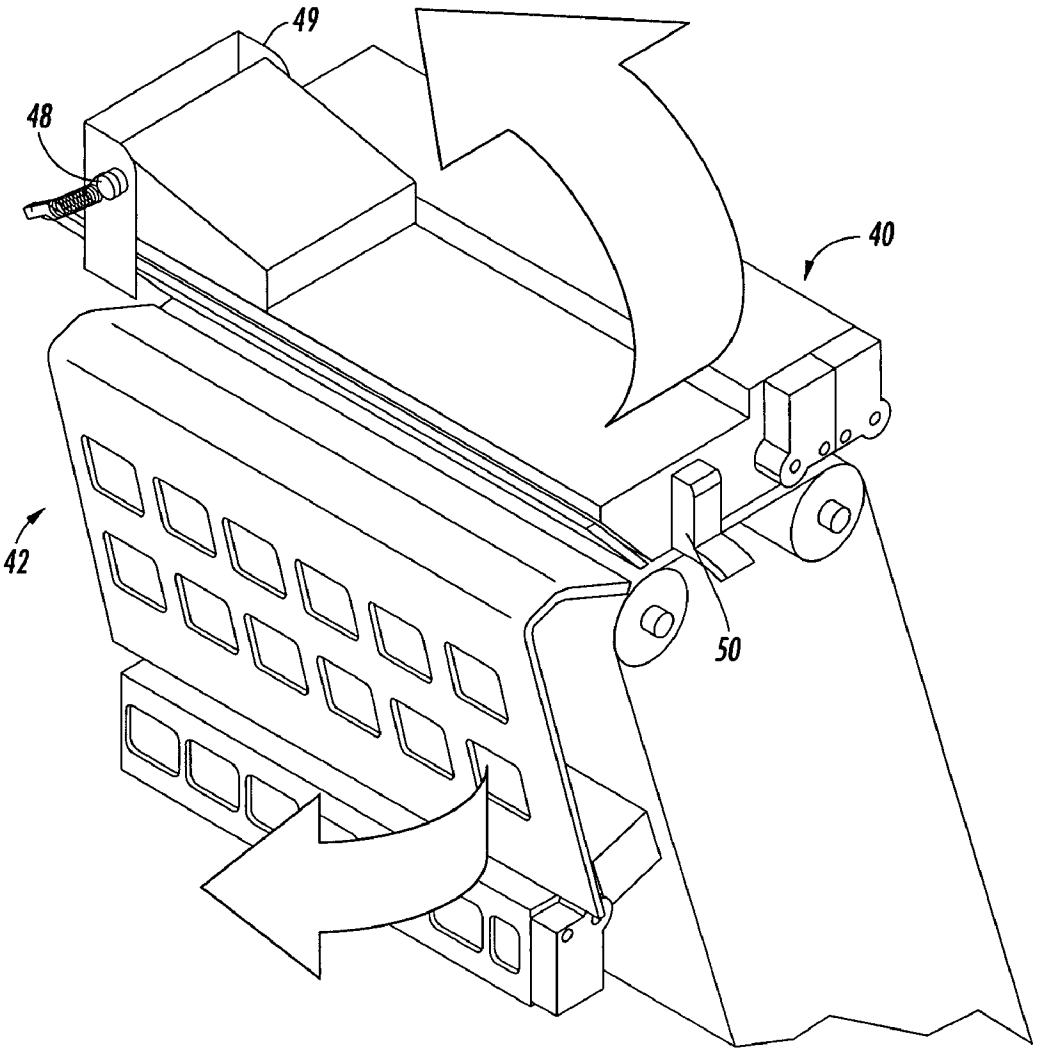
FIG. 1 is a schematic upper left perspective view of an exemplary embodiment of a transfer module.
Figure 2:
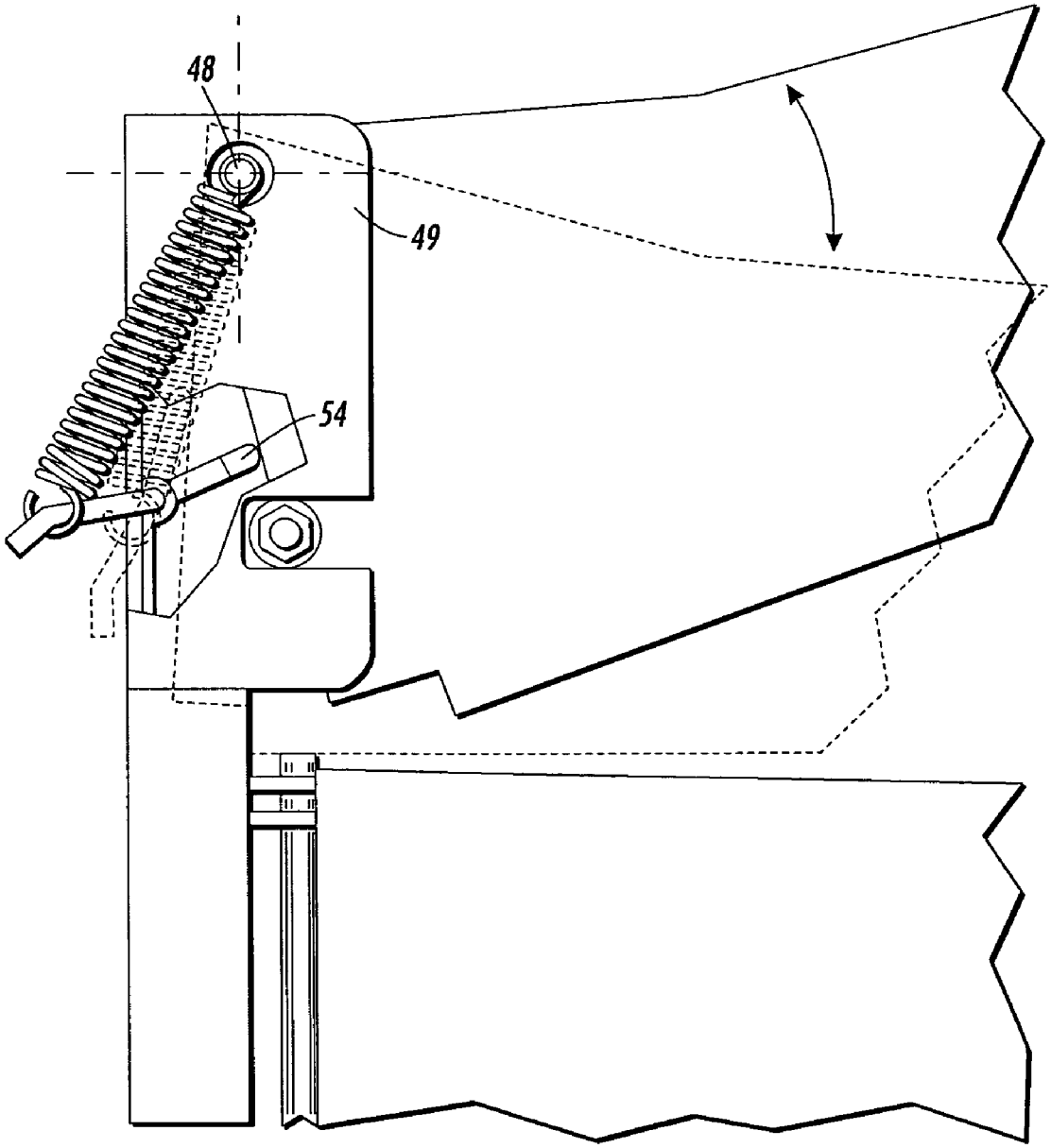
FIG. 2 is a schematic left-side close-up view of the rear portion of the exemplary embodiment of the transfer module.
Figure 3:
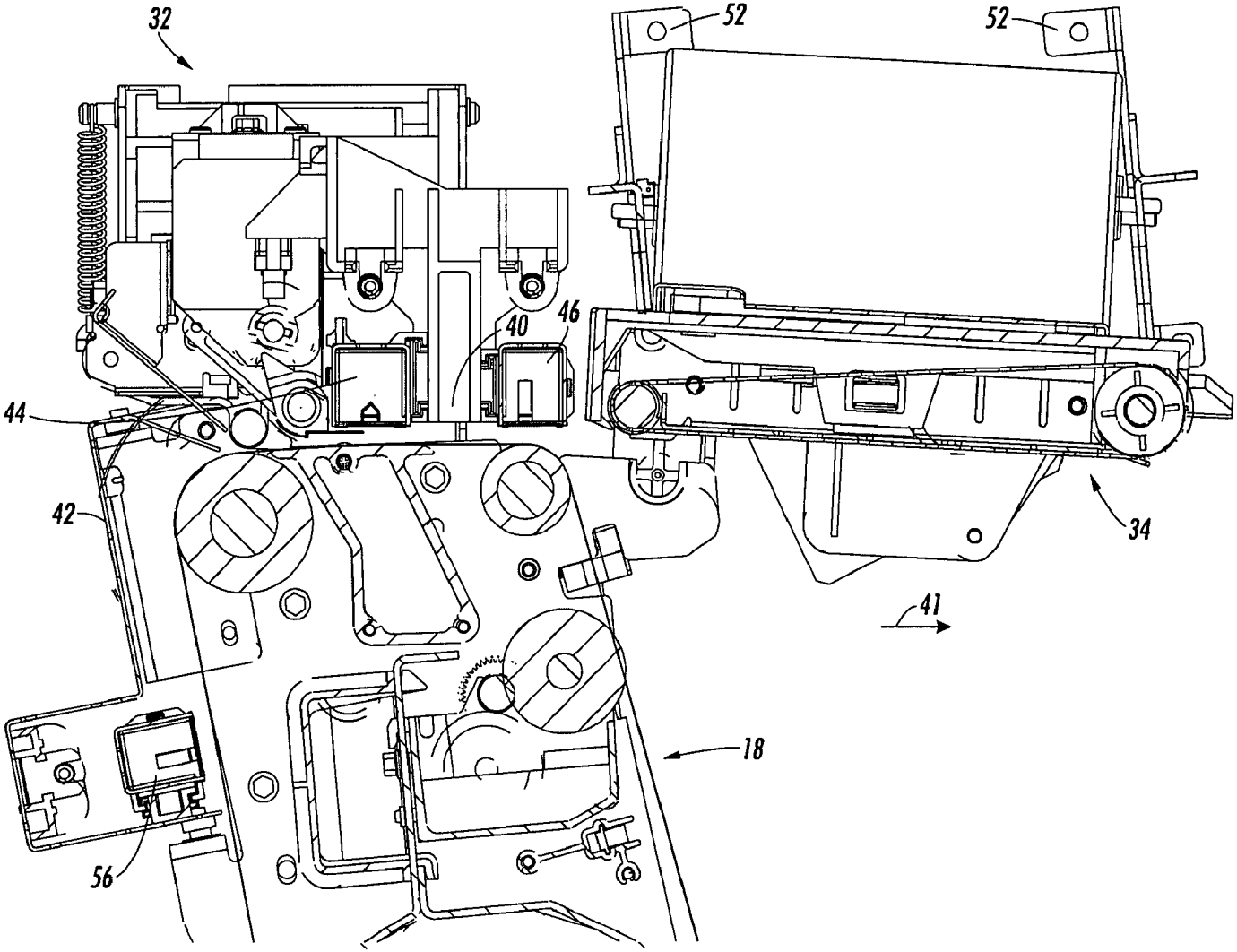
FIG. 3 is a schematic front elevational view of the upper portion of an exemplary embodiment of a transfer module along with a pre-fuser transport and an upper portion of a photoreceptor module.
Figure 4:
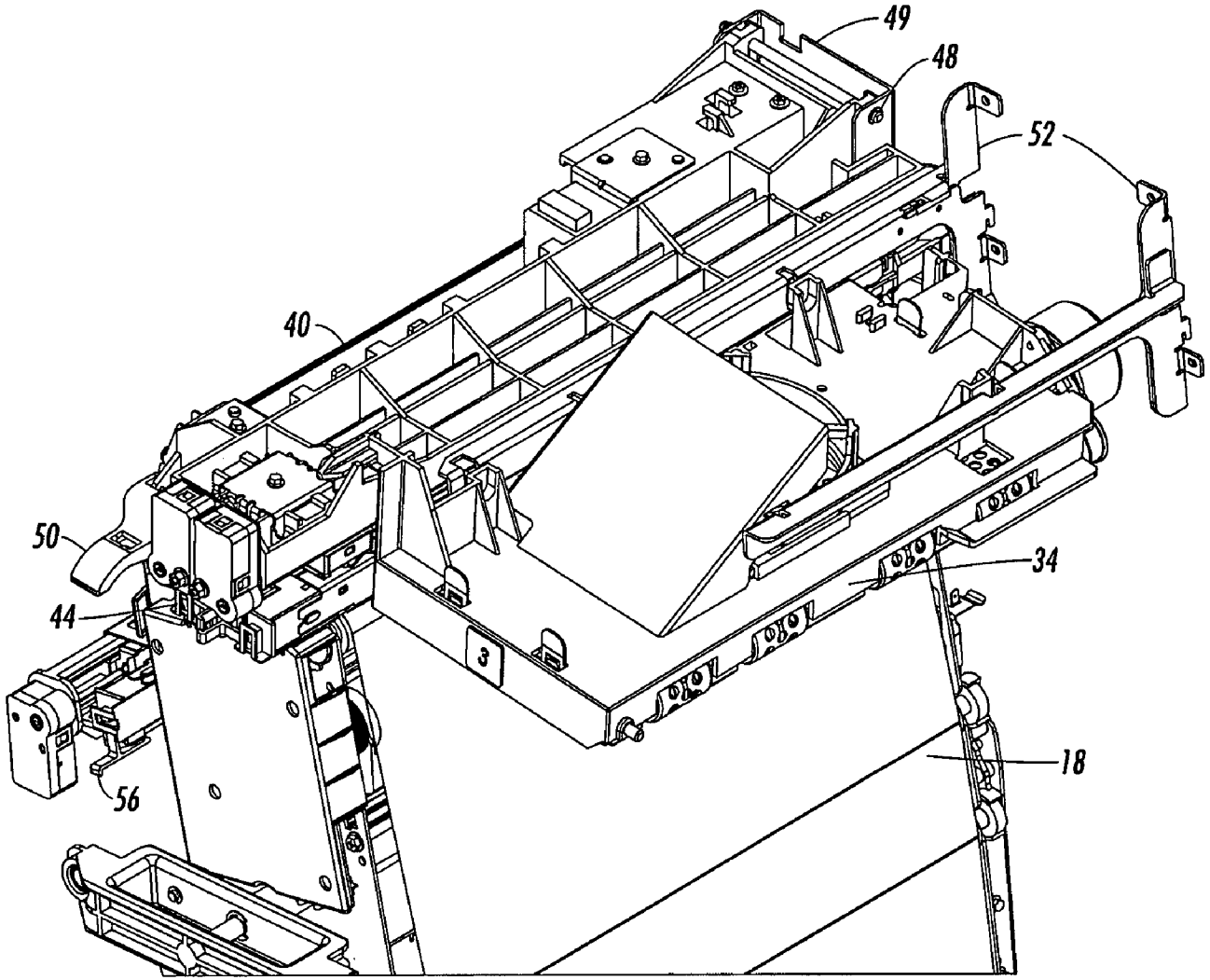
FIG. 4 illustrates a schematic upper right perspective view of an exemplary embodiment of a pre-fuser transport and a transfer module.

Turning to FIGS. 3 and 4, the device 10 also includes a pre-fuser transport module (PFT) 34 that conveys sheets from the transfer module 32 to the fuser module 36. In embodiments, PFT 34 rests on the outboard end of the transfer frame, and is therefore lifted when the transfer assembly 32 is lifted. Brackets 52, which support the PFT 34 when the belt module drawer 39 is pulled out of the printing device, limit the travel of the PFT 34. This, in turn, limits the amount that the transfer module 32 may be lifted when it is inside the device. This provides a limited space for jam clearance. In embodiments, a space of about ½ inch is available. This is sufficient for a customer to remove a jammed sheet, but will not allow the customer to insert his fingers into the transfer area, where he might damage the photoreceptor belt, or touch the sharp pins on the detack corotron 46. The embodiments shown in FIGS. 3 and 4 also ease jam clearance in the PFT 34 as well.

In embodiments, the entire photoreceptor module 38, along with the transfer and pre-transfer modules, pulls out of the printer on slides to allow for maintenance, especially replacement of the photoreceptor belt. For example, these components may be part of the same drawer 39, which is schematically shown in FIG. 5. When the photoreceptor module drawer 39 is pulled out of the housing 14, the PFT 34 no longer limits the amount the transfer module 32 may be lifted, and the transfer module may be lifted to provide a wider gap at the outboard side. For example, in embodiments, a gap of approximately 3 inches is used, which is sufficient for purposes of belt replacement. Also, a propping mechanism may be used to hold the transfer module 32 away from the photoreceptor module 38 during belt replacement. For example, when the transfer module 32 is lifted, a spring-loaded "prop rod" 54 at the rear of the module can automatically latch into position to hold the module open while a photoreceptor belt is replaced. Other propping mechanisms may be used as well, including, for example, a friction clutch or a 1-way clutch with a release mechanism.

Referring back to FIG. 1, the lower paper baffle 42 can be mounted separately to the photoreceptor module 38. In embodiments, it also pivots away from the photoreceptor module to allow the photoreceptor belt to be removed. The lower paper baffle 42 is located at the outboard side by fixed staging points, which rest against the outboard frame of the module and the outboard ball bearing of the photoreceptor drive roll. It carries a spring, which contacts the registration transport when the photoreceptor drawer 39 is in its operational position within the device 10, and pushes the baffle to the closed (run) position. Alternately, the spring may be mounted in the drawer assembly. This baffle 42 is part of a larger bracket that also serves to mount the pre-transfer corotron 56.

This strategy provides superior ease of jam clearance from the transfer area, especially on short or heavy weight sheets. It also eases for photoreceptor belt replacement without any disassembly of the transfer subsystem.

Connecting the transfer assembly 32 to the PFT 34 so that they move in unison when inside the device helps a user to locate the pre-fuser transport 34 relative to the photoreceptor. Once the transfer module 32 is located relative to the housing 14 and relative to the photoreceptor module 38 within the housing 14, the PFT 34 would be located as well as constrained by the movement of the transfer module.

While the present invention has been described with reference to specific embodiments thereof, it will be understood that it is not intended to limit the invention to these embodiments. It is intended to encompass alternatives, modifications, and equivalents, including substantial equivalents, similar equivalents, and the like, as may be included within the spirit and scope of the invention. All patent applications, patents and other publications cited herein are incorporated by reference in their entirety.

What is claimed is:

1. An electrophotographic printing apparatus, comprising:

a housing;

a photoreceptor module located inside the housing that includes a photoreceptor, wherein the module is part of a drawer assembly that may be removed on slides from an operating position inside the housing;

a raster output system located inside the housing for projecting an electrostatic image onto the photoreceptor;

a charging station;

a developer station;

a transfer station mounted to the photoreceptor module;

a pre-fuser transport mounted independently of the photoreceptor module; and a fusing station, wherein the transfer station is located relative to the pre-fuser transport so that they are constrained to move as one unit when the photoreceptor module is in its operating position inside the housing but the constraint is removed when the photoreceptor module is removed from its operating position inside the housing.

2. The apparatus of claim 1, wherein the pre-fuser transport is connected to the housing by at least one bracket.

3. The apparatus of claim 1, wherein at least a portion of the transfer station and the pre-fuser transport can pivot away from their operating positions when the photoreceptor module is in its operating station inside the housing.

4. The apparatus of claim 3, wherein the transfer station and the pre-fuser transport have inboard and outboard ends, and where the at least a portion of the transfer station and the pre-fuser transport can pivot such that the outboard ends of the transfer station and the pre-fuser transport can move up to ½ inch when the photoreceptor module is in its operating position inside the housing.

* * * * *